US005260715A

United States Patent [19]

Kishimi

[11] Patent Number: 5,260,715

[45] Date of Patent: Nov. 9, 1993

[54] METHOD OF AND APPARATUS FOR THERMALLY RECORDING IMAGE ON A TRANSPARENT HEAT SENSITIVE MATERIAL

[75] Inventor: Kazutomo Kishimi, Tokyo, Japan

[73] Assignee: Fuji Photo Film Co., Ltd., Kanagawa, Japan

[21] Appl. No.: 870,103

[22] Filed: Apr. 17, 1992

Related U.S. Application Data

[63] Continuation of Ser. No. 371,851, Jun. 27, 1989.

[30] Foreign Application Priority Data

Jun. 28, 1988 [JP] Japan ..... 63-160267

[51] Int. Cl.[5] ..... B41J 2/32

[52] U.S. Cl. ..... 346/76 PH; 346/1.1

[58] Field of Search ..... 346/1.1; 360/76 PH; 400/120

[56] References Cited

U.S. PATENT DOCUMENTS

| | | | |
|---|---|---|---|
| 4,525,722 | 6/1985 | Sachdev et al. | 346/76 PH |
| 4,596,991 | 6/1986 | Adomkaitis et al. | 346/76 PH |
| 4,777,496 | 10/1988 | Maejima et al. | 346/76 PH |
| 4,857,501 | 8/1989 | Usami et al. | 503/200 |
| 4,875,056 | 10/1989 | Ono | 346/76 PH |

FOREIGN PATENT DOCUMENTS 0224376 11/1985 Japan .
0245365 12/1985 Japan .
0265682 11/1988 Japan .

OTHER PUBLICATIONS

Electronic Design, vol. 30, No. 9 (Apr. 29, 1982) p. 70E.

*Primary Examiner*—Benjamin R. Fuller
*Assistant Examiner*—Huan Tran
*Attorney, Agent, or Firm*—Sughrue, Mion, Zinn, Macpeak & Seas

[57] ABSTRACT

An image is recorded on a transparent heat sensitive material having a transparent support and a transparent heat sensitive layer disposed on the transparent support. The transparent heat sensitive material is moved in an auxiliary scanning direction. Image information is recorded on the transparent heat sensitive material in a main scanning direction substantially normal to the auxiliary scanning direction with a thermal head having an array of as many heating elements as the number of pixels along the main scanning direction, so that the transparent heat sensitive material is two-dimensionally scanned to record an image in an image area thereon. A non-image area of the heat sensitive material other than the image area thereof is recorded at a predetermined density level. The array of heating elements has a length larger than the width of the transparent heat sensitive material in the main scanning direction, so that the entire surface of the non-image area can be recorded at the predetermined density level.

21 Claims, 7 Drawing Sheets

METHOD OF AND APPARATUS FOR THERMALLY RECORDING IMAGE ON A TRANSPARENT HEAT SENSITIVE MATERIAL

This is a continuation of U.S. patent application Ser. No. 07/371,851 filed Jun. 27, 1989, now abandoned.

BACKGROUND OF THE INVENTION

The present invention relates to a method of and an apparatus for recording an image, and more particularly to a method of and an apparatus for thermally recording an image, characters, or the like on a heat sensitive material with a thermal head, such that an area of the heat sensitive material other than the area in which the image or the like is thermally recorded in response to an input signal is thermally recorded at a predetermined density level.

Various new medical image diagnostic apparatus such as ultrasonic imaging apparatus, X-ray computerized tomographic apparatus, and nuclear magnetic resonance imaging apparatus have recently been widely used in addition to conventional X-ray photographic apparatus in the medical field. In such medical image diagnostic apparatus, an ultrasonic beam or X ray is applied to the body of a patient, and any change in the ultrasonic or X-ray energy that has passed through or been reflected from the patient's body is detected. Based on the detected change, image information of a localized region in the patient's body is produced. The image information is then displayed on a CRT, for example. A multiformat camera is used to record the image displayed on the CRT on a photosensitive material such as a silver-salt film through an optical system.

Subsequently, the film with such images recorded thereon are usually observed on a light table such as an illuminating box by a doctor who then diagnoses the imaged region based on the image information.

As shown in FIG. 1 of the accompanying drawings, when a film 2 is observed on a light table, the intensity of light which passes through a non-image frame area 6. of the film 2 is quite large as compared with an image area 4 of the film 2, making it difficult for the doctor to view the image area 4 which contains necessary information. In order to eliminate this drawback, there has been proposed an image recording apparatus which employs a scanning light beam, as disclosed in Japanese Laid-Open Patent Publication No. 60-224376 or 60-245365. According to the disclosed image recording apparatus, a non-image area of a film other than an image area thereof is blackened to a predetermined density level by being scanned by a light beam.

Since the proposed image recording apparatus employs a mechanism for scanning the light beam, the apparatus is large in overall size. Furthermore, the apparatus is expensive to manufacture as an optical system including a light deflector is highly costly, and the apparatus is not easy to use as the adjustment of the optical system is time-consuming. After an image has been recorded as a latent image on a silver-salt film in the disclosed image recording apparatus, the image has to be developed into a visible image which must then be fixed to the film. If a film with images fixed thereto is to be produced from the image recording apparatus, an automatic developing machine needs to be combined with the image recording apparatus. Therefore, an entire system including the image recording apparatus and the automatic developing machine is considerably large in size.

Heat sensitive recording processes employing heat sensitive materials for thermally recording images thereon are finding wide use in facsimile receivers and printers since the processes are easy to perform, the apparatus used are simple in structure and inexpensive to manufacture.

Heretofore, a transparent heat sensitive material is used in a heat sensitive recording process. More specifically, the transparent heat sensitive material is placed in intimate contact with an original, and light is applied to the heat sensitive material. The image area of the original then absorbs infrared radiation, which increases the temperature of the image area to enable the heat sensitive material to develop a color. The heat sensitive material however does not have a heat sensitivity which is high enough for the thermal head in a facsimile receiver to thermally record an image on the heat sensitive material. Another conventional heat sensitive material which can thermally record an image with a thermal head includes a heat sensitive layer which is not transparent. Therefore, even if such an opaque heat sensitive layer is coated on a transparent support, the resulting heat sensitive material does not have a desired degree of transparency.

Under the circumstances, there has been a demand for a transparent heat sensitive material on which an image can directly be recorded by a thermal head, so that the developed image on the heat sensitive material can be viewed on a light table or an overhead projector.

To meet such a demand, a heat sensitive material has been developed as disclosed in Japanese Patent Application 62-88197 filed by the applicant. The disclosed heat sensitive material has a heat sensitive layer coated on a support and having microcapsules containing at least a color former and a color developer. According to a first feature of the heat sensitive material, the color former comprises a colorless or a light colored electron donating dye precursor. After at least the color developer has been dissolved in in an organic solvent which is slightly soluble or insoluble in water, a coating agent comprising an emulsified dispersion and the microcapsules is prepared, and then coated and dried on the support. According to a second feature, the organic solvent in which the color developer is dissolved is ester. According to a third feature, the support comprises a transparent film. The heat sensitive material thus formed has a transparent heat sensitive layer which has high heat sensitivity. By coating the heat sensitive material on a transparent support, there is obtained a transparent heat sensitive material which is easily capable of producing a color using a thermal head.

SUMMARY OF THE INVENTION

It is a major object of the present invention to provide a method of and an apparatus for thermally recording an image, characters, or the like on a transparent heat sensitive material with a thermal head, such that an area of the heat sensitive material other than the area in which the image or the like is thermally recorded in response to an input signal is thermally recorded at a predetermined density level, so that the area other than the image area is blackened to the predetermined density level, allowing the image on the heat sensitive material to be easily visible when observed on a light table such as an illuminating box.

Another object of the present invention is to provide a method of recording an image on a transparent heat sensitive material having a transparent support and a transparent heat sensitive layer disposed on the transparent support, the method comprising the steps of moving the transparent heat sensitive material in an auxiliary scanning direction, recording image information on the transparent heat sensitive material in a main scanning direction substantially normal to the auxiliary scanning direction with a thermal head having an array of as many heating elements as the number of pixels along the main scanning direction, so that the transparent heat sensitive material is two-dimensionally scanned to record an image in an image area thereon, and recording a non-image area of the heat sensitive material other than the image area thereof at a predetermined density level.

Still another object of the present invention is to provide the image recording method wherein the array of heating elements has a length larger than the width of the transparent heat sensitive material in the main scanning direction, so that the entire surface of the non-image area can be recorded at the predetermined density level.

Yet another object of the present invention is to provide an apparatus for recording an image on a transparent heat sensitive material having a transparent support and a transparent heat sensitive layer disposed on the transparent support, the apparatus comprising means for moving the transparent heat sensitive material in an auxiliary scanning direction, a thermal head having an array of as many as heating elements as the number of pixels along a main scanning direction substantially normal to the auxiliary scanning direction a frame memory for storing a frame of input image data, a line buffer memory for storing a line of input image data corresponding to a scanning line and supplied from the frame memory, the line buffer memory having at least memory areas corresponding respectively to the heating elements, initial data input means for supplying initial density level data corresponding to one scanning line to the line buffer memory, thermal head drive means for energizing the heating elements to record image information on the transparent heat sensitive material in the main scanning direction while the transparent heat sensitive material is being moved in the auxiliary scanning direction, so that the transparent heat sensitive material is two-dimensionally scanned to record an image in an image area thereof, and means for recording a non-image area of the heat sensitive material other than the image area thereof at a predetermined density level represented by the initial density level data.

Yet still another object of the present invention is to provide an apparatus for recording an image on a transparent heat sensitive material having a transparent support and a transparent heat sensitive layer disposed on the transparent support, the apparatus comprising means for moving the transparent heat sensitive material in an auxiliary scanning direction, a thermal head having an array of as many as heating elements at the number of pixels along a main scanning direction substantially normal to the auxiliary scanning direction, a frame memory for storing a frame of input image data, a line buffer memory for storing a line of input image data corresponding to a scanning line and supplied from the frame memory, the line buffer memory having at least memory areas corresponding respectively to the heating elements, initial data input means for supplying initial density level data corresponding to one scanning line to the frame memory, thermal head drive means for energizing the heating elements to record image information on the transparent heat sensitive material in the main scanning direction while the transparent heat sensitive material is being moved in the auxiliary scanning direction, so that the transparent heat sensitive material is two dimensionally scanned to record an image in an image area thereof, and means for recording a non-image area of the heat sensitive material other than the image area thereof at a predetermined density level represented by the initial density level data.

A further object of the present invention is to provide an apparatus for recording an image on a transparent heat sensitive material having a transparent support and a transparent heat sensitive layer disposed on the transparent support, the apparatus comprising means for moving the transparent heat sensitive material in an auxiliary scanning direction, a thermal head having an array of as many as heating elements as the number of pixels along a main scanning direction substantially normal to the auxiliary scanning direction, a frame memory for storing initial density level data in all memory addresses thereof and for storing a frame of input image data over the stored initial image data, a line buffer memory for storing a line of input image data corresponding to a scanning line and supplied from the frame memory, the line buffer memory having at least memory areas corresponding respectively to the heating elements, thermal head drive means for energizing the heating elements to record image information on the transparent heat sensitive material in the main scanning direction while the transparent heat sensitive material is being moved in the auxiliary scanning direction, so that the transparent heat sensitive material is two-dimensionally scanned to record an image in an image area thereof, and means for recording a non-image area of the heat sensitive material other than the image area thereof at a predetermined density level represented by the initial density level data.

A still further object of the present invention is to provide the image recording apparatus wherein the array of heating elements has a length larger than the width of the transparent heat sensitive material in the main scanning direction, so that the entire surface of the non-image area can be recorded at the predetermined density level.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
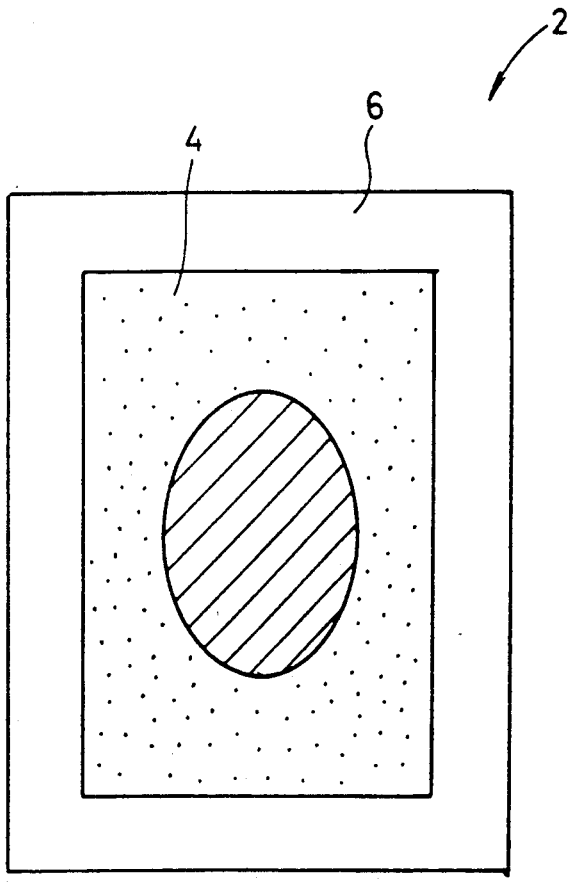
FIG. 1 is a schematic view of an image formed on a film produced by a conventional image recording apparatus.
Figure 2:
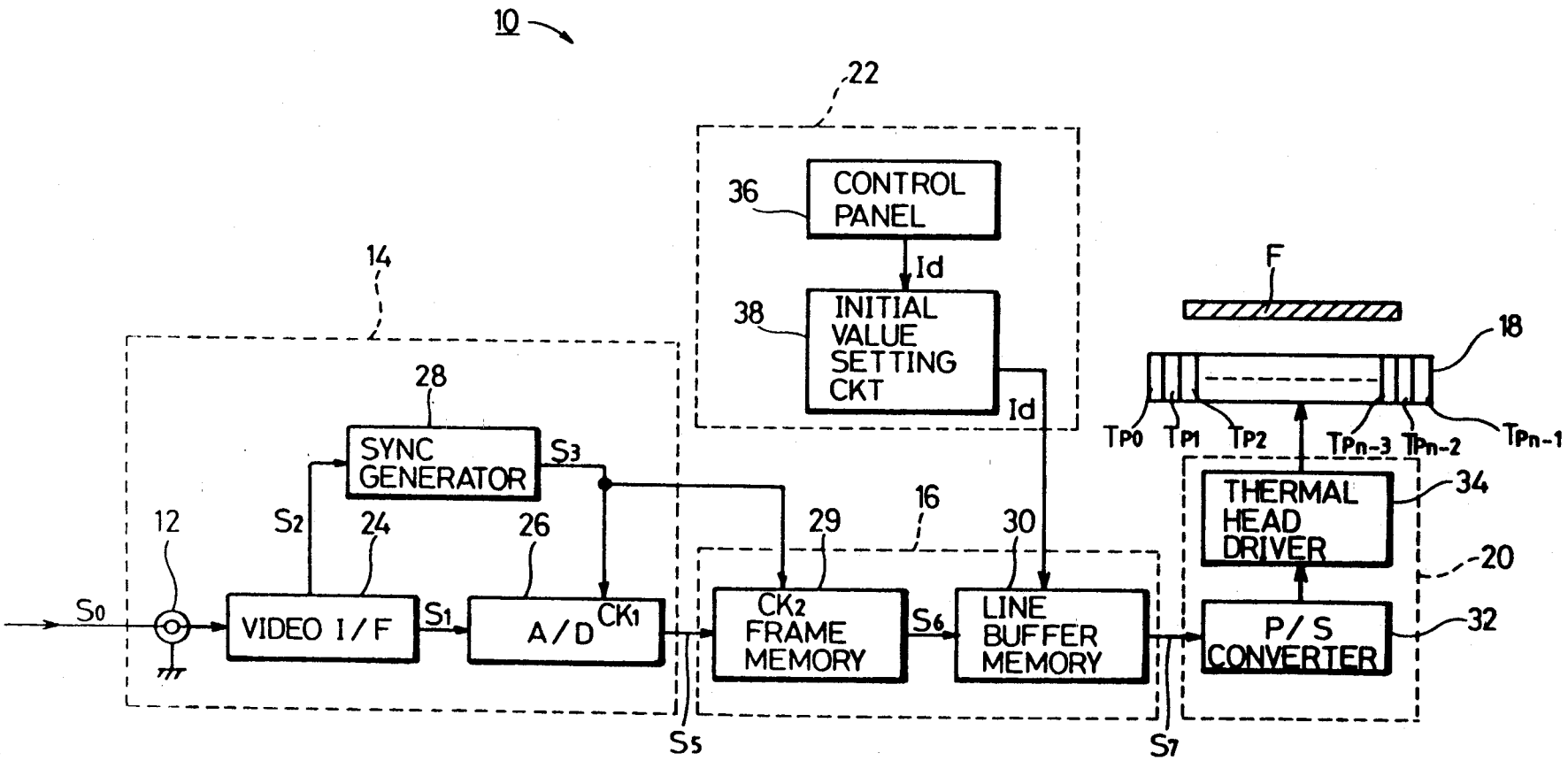
FIG. 2 is a circuit diagram of a thermal head drive system in an image recording apparatus according to the present invention.

As shown in FIG. 2, an image recording apparatus according to the present invention includes a thermal head drive system generally denoted at 10. The thermal head drive system 10 basically includes a video signal reading unit 14 for reading a video signal applied from a video signal input terminal 12, a video signal memory unit 16 for temporarily storing an output signal from the video signal reading unit 14, a thermal head drive unit 20 responsive to an output signal from the video signal memory unit 16 for driving a thermal head 18, and an initial value setting unit 22 for giving an initial value for background density to the video signal memory unit 16.

The video signal reading unit 14 has a video interface (I/F) 24 to which a composite video signal $S_0$ including a video signal and a synchronizing signal is applied from an X-ray computerized tomographic apparatus (not shown). The composite video signal $S_0$ is separated into a video signal $S_1$ and a composite sync signal $S_2$ by the video I/F 24. The video signal $S_1$ is applied from the video I/F 24 to a signal input terminal of an A/D converter 26, and the composite sync signal $S_2$ is applied from the video I/F 24 to a sync generator 28. A clock signal $S_3$ is supplied from the sync generator 28 to a clock input terminal $CK_1$ of the A/D converter 26.

An output signal $S_5$ representing digital image data from the A/D converter 26 is applied to a frame memory 29 each time the clock signal $S_3$ is supplied to a clock input terminal $CK_2$ of the frame memory 29. The frame memory 29 supplies line data $S_6$ to a line buffer memory 30 having as many memory addresses as the number of heating elements of the thermal head 18. The line buffer memory 30 then supplies line data $S_7$ through a parallel/serial (P/S) converter 32 to a thermal head driver 34 comprising a shift register, etc.

The thermal head driver 34 applies an output signal to n heating elements Tp0 through Tpn−1 of the thermal head 18. An image represented by the supplied output signal is thermally recorded by the heating elements Tp0 through Tpn−1 on a heat sensitive material such as a transparent heat sensitive film F which is fed in an auxiliary scanning direction by a feed mechanism (not shown).

Figure 3:
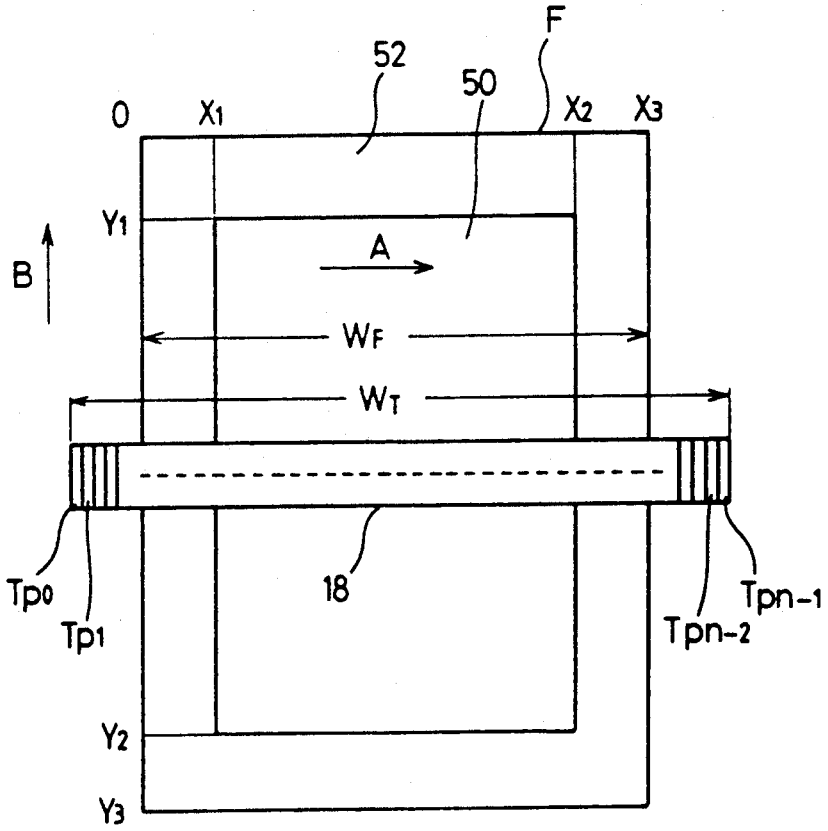
FIG. 3 is a view showing the positional relationship between a transparent heat sensitive film and a thermal head.

The heating elements Tp0 through Tpn−1 and the transparent heat sensitive film F are positioned relatively to each other as shown in FIG. 3. More specifically, the n heating elements Tp0 through Tpn−1 are arrayed in a main scanning direction (indicated by the arrow A) which is normal to the auxiliary scanning direction (indicated by the arrow B) in which the transparent heat sensitive film F is fed. The thermal head 18 has an effective print width $W_T$ slightly larger than the film width WF. Stated otherwise, the length of the array of the heating elements Tp0 through Tpn-1 along the main scanning direction is greater than the width of the transparent heat sensitive film F along the main scanning direction.

In FIG. 3, the transparent heat sensitive film F has an image recording area (hereinafter referred to as an "image area") 50 extending between positions $X_1$ and $X_2$ in the main scanning direction and between positions $Y_1$ and $Y_2$ in the auxiliary scanning direction. The transparent heat sensitive film F also has a non-image recording area (hereinafter referred to as a "non-image area") extending between positions O and $X_1$ and between positions $X_2$ and $X_3$ in the main scanning direction and also between positions and $Y_1$ and between positions $Y_2$ and $Y_3$ in the auxiliary scanning direction.

The line buffer memory 30 is supplied with an initial background density value Id through an initial value setting circuit 38 each time the film F is to be scanned along a main scanning line. The initial background density value Id is set by a control panel 36 comprising a keyboard or the like.

The transparent heat sensitive film F is made of the heat sensitive material as disclosed in Japanese Patent Application No. 62-88197.

More specifically, the heat sensitive material has a heat sensitive layer coated on a support and having microcapsules containing at least a color former and a color developer. The color former comprises a colorless or a light colored electron donating dye precursor. After at least the color developer has been dissolved in in an organic solvent which is slightly soluble or insoluble in water, a coating agent comprising an emulsified dispersion and the microcapsules is prepared, and then coated and dried on the support.

Electron donating dye precursors to be employed in the present invention are selected suitably from known colorless or light colored compounds of the kind which can develop their colors by donating an electron or accepting a proton of an acid or the like. These compounds have a skeleton such as that of lactone, lactam, sultone, spiropyran, ester and amide, as a part of their structures, and these skeletons undergo ring-opening or bond cleavage upon contact with a color developer. Preferred examples of such compounds include triarylmethane compounds, diphenylmethane compounds, xanthene compounds, thiazine compounds, and spiropyran compounds.

Particularly preferred compounds are those represented by the following general formula:

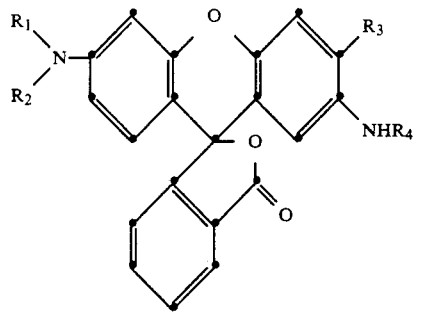

In the above formula, $R_1$ represents an alkyl group containing 1 to 8 carbon atoms; $R_2$ represents an alkyl or alkoxyalkyl group containing 4 to 18 carbon atoms, or a tetrahydrofuryl group; $R_3$ represents a hydrogen atom, an alky group containing 1 to 15 carbon atoms, or a halogen atom; and $R_4$ represents a substituted or unsubstituted aryl group containing 6 to 20 carbon atoms. As substituent group for $R_4$, alkoxy, and halogenated alkyl groups containing 1 to 5 carbon atoms, and halogen atoms are preferred.

Microencapsulation of the above-described color former can prevent generation of fog during production of a heat sensitive material and, at the same time, can improve the keeping qualities of the heat sensitive material and the keeping qualities of the record formed. The image density at the time of recording can be heightened by suitably selecting a material and a method of forming a microcapsule wall. A preferred amount of the color former used is 0.05 to 5.0 g/m$^2$.

Suitable examples of wall materials for microcapsules include polyurethane, polyurea, polyester, polycarbonate, urea/formaldehyde resin, melamine resin, polystyrene, styrene/methacrylate copolymer, styrene/acrylate copolymer, gelatin, polyvinyl pirrolidone, and polyvinyl alcohol. These macromolecular substances can be used in combination of two or more thereof.

Of the above-cited macromolecular substances, polyurethane, polyurea, polyamide, polyester, and polycarbonate are preferred. In particular, polyurethane and polyurea can bring about good results.

Microcapsules to be employed in the present invention are preferably prepared by emulsifying a core material containing a reactive substance like a color former, and then forming a wall of a macromolecular substance around the droplets of the core material to microencapsulate the core material. Reactants to produce a macromolecular substance are added to the inside and/or the outside of the oily droplets. For details of microcapsules which can be preferably employed in the present invention, e.g., for production methods of microcapsules which can be preferably used, the description in Japanese Laid Open Patent Publication No. 59-222716, for example.

An organic solvent to constitute the above-described oil droplets can be suitably selected from those used generally for pressure sensitive material.

Some desirable oils are compounds represented by the following general fomulae (I) to (III), triarylmethanes (such as tritoluylmethane, toluyldiphenylmethane), terphenyl compounds (such as terphenyl), alkylated diphenyl esters (such as propyldiphenyl ester), hydrogeneted terphenyl compounds (such as hyxahydroterphenyl), diphenyl ethers, chlorinated paraffins, and so on.

(I)

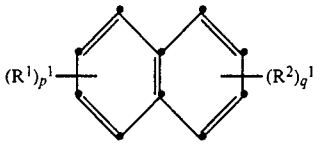

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represent an integer of 1 to 4, provided that the total number of alkyl groups therein is 4 or less. Preferred alkyl groups represented by $R^1$ and $R^2$ are those containing 1 to 8 carbon atoms.

(II)

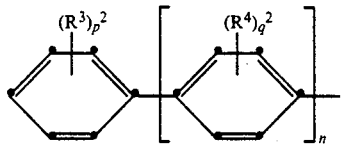

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represent an integer of 1 to 4. The total number of alkyl groups is 4 or less in case of n=1, while it is 6 or less in case of n=2.

(III)

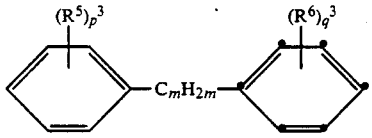

In the above formula, $R^5$ and $R^6$, which may be the same or different, each represent a hydrogen atom, or an alkyl group containing 1 to 18 carbon atoms. m represents an integer of 1 to 13. $p^3$ and $q^3$ each represent an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (I) include dimethylnaphthalene, diethylnaphthalene, and diisopropylnaphthalene.

Specific examples of the compounds represented by the formula (II) include dimethylbiphehyl, diethylbiphenyl, diisopropylbiphenyl, and diisobutylbiphenyl.

Specific examples of the compounds represented by the forumula (III) include 1-methyl-1-dimethylphenyl-1-phenylmethane. 1-ethyl-1-dimethylphenyl-1-phenylmethane. and 1-propyl-1-dimethylphenyl-1-phenylmethane.

The above-cited oils can be used as a mixture of two or more thereof, or in combination with other oils.

A preferred size of microcapsules to be employed in the present invention is 4 $\mu$ or less, particularly to the evaluation method described in Japanese Laid-Open Patent Publication No. 60-214990, for example.

Desirable microcapsules which are produced in the above-described manner are not those of the kind which are disrupted by heat or pressure, but those of the kind which have a microcapsule wall through which reactive substances present inside and outside the individual microcapsules respectively can permeate to react with each other.

Multicolored neutral tints can be effected by preparing some kinds of microcapsules having walls differing in glass transition point through suitable selection of wall materials, and optional addition of glass transition point controlling agents (e.g., plasticizers described in Japanese Laid-Open Patent Publication No. 60-119862) to the wall materials, respectively, and further by combining selectively colorless electron donating dye precursors differing in hue with their respective color developers. Therefore, the present invention is not limited to a monochromatic heat sensitive recording material but can be applied to a twocolor or multicolor heat sensitive recording material and a heat sensitive recording material suitable for recording of a graded image.

In addition, a photodiscoloration inhibitor as described in Japanese Patent Applications Nos. 60-125470, 60-125471, and 60-125472, for example, can be added, in desired amounts.

Color developers to be employed in the present invention, which undergo the color development reaction with electron donating colorless precursors when heated, can be those selected suitably from known color developers. For instance, suitable examples of color developers to be combined with leuco dyes include phenol compounds, sulfercontained phenolic compounds, carboxylic acid compounds, sulfon compounds, urea or thiourea compounds. Details of the color developers are described, e.g., in "Kami Pulp Gijutsu Times," pp. 49–54, and pp. 65–70 (1985). Of such color developers, those having melting points of 50 to 250° C., particularly phenols and organic acids which have melting points of 60° to 200° C. and are barely soluble in water, are preferred over others. Combined use of two or more of color developers is desirable because of increase in solubility.

Color developers preferred particularly in the present invention are represented by the following general formulae (IV) to (VII):

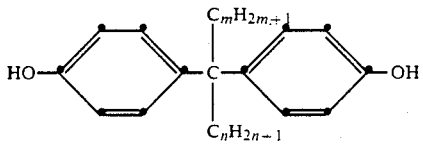

(IV)

m = 0~2, n = 2~11

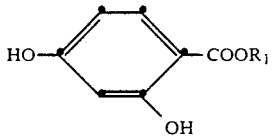

(V)

$R_1$ is an alkyl group, an aryl group, or an aralkyl group. In particular, a methyl group, an ethyl group, or a butyl group is preferred as $R_1$.

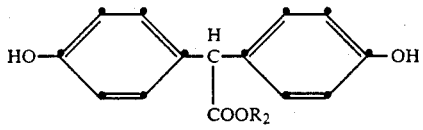

(VI)

$R_2$ is an alkyl group. In particular, a butyl group, a pentyl group, a heptyl group, or an octyl group is preferred as $R_2$.

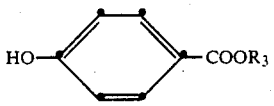

(VII)

$R_3$ is an alkyl group or an aralkyl group.

In the present invention, such a color developer is used in the form of emulsified dispersion. The dispersion can be prepared by dissolving color developer in an organic solvent sightly soluble or insoluble in water, and mixing the resulting solution with an aqueous phase which contains a surface active agent, and a water-soluble high polymer as a protective colloid to emulsify and to disperse the solution in the aqueous phase.

An organic solvent to be used for dissolving the color developers can be suitably selected from those used generally for pressure sensitive material.

Some desirable oils are compounds represented by the following general fomulae (V) to (VII), triarylmethanes (such as tritoluylmethane, toluyldiphenylmethane) terphenyl compounds (such as terphenyl), alkylated diphenyl esters (such as propyldiphenyl ester), hydrogeneted terphenyl compounds (such as hyxahydroterphenyl), diphenyl ethers, chlorinated paraffins, and so on.

In the present invention, esters having high boiling point are preferable from the viewpoints of solubility of the color developer and emulsion stability of the emulsified dispersion of the color developer.

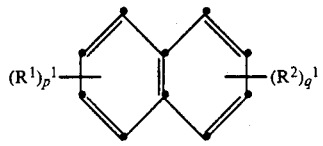

(V)

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represent an integer of 1 to 4, provided that the total number of alkyl groups therein is 4 or less. Preferred alkyl groups represented by $R^1$ and $R^2$ are those containing 1 to 8 carbon atoms.

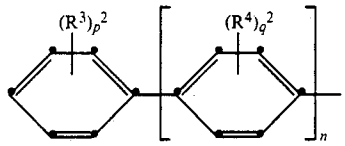

(VI)

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represent an integer of 1 to 4. The total number of alkyl groups is 4 or less in case of n=1, while it is 6 or less in case of n=2.

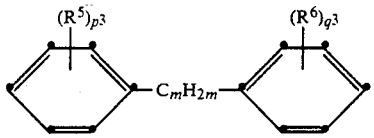

(VII)

In the above formula, $R^5$ and $R^6$, which may be the same or different, each represent a hydrogen atom, or an alkyl group containing 1 to 18 carbon atoms. m represents an integer of 1 to 13. $p^3$ and $q^3$ each represent an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (V) include dimethylnaphthalene, diethylnaphthalene, and diisopropylnaphthalene.

Specific examples of the compounds represented by the formula (VI) include dimethylbiphehyl, diethylbiphenyl, diisopropylbiphenyl. and diisobutylbipheny .

Specific examples of the compounds represented by the forumula (VII) include 1-methyl-1-dimethylphenyl-1-phenylmethane, 1-ethyl-1-dimethylphenyl-1-phenylmethane, and 1-propyl-1-dimethylphenyl-1-phenylmethane.

Specific examples of esters include phosphates (e.g., triphenyl phosphate, tricresyl phosphate, butyl phosphate, octyl phosphate, cresyl diphenyl phophate), phthalates (e.g., dibutyl phthalate, 2-ethylhexyl phthalate, ethyl phthalate, octyl phthalate, butyl benzyl phthalate, tetrahydro dioctyl phthalate), benzoates (e.g., ethyl benzoate, propyl benzoate, butyl benzoate, isopentyl benzoate, benzyl benzoate), abietates (e.g., ethyl abietate, benzyl abietate), dioctyl adipate, isodesyl succinate, dioctyl azelate, oxalates (e.g., dibutyl oxalate, dipentyl oxalate), diethyl malonate, maleates (e.g., dimethyl maeate, diethyl maleate, dibutyl maleate), tributyl citrate, sorbin esters (e.g., metyl sorbate, ethyl sorbate, butyl sorbate), sebacic esters (e.g., dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic monoesters and diesters), triacetin, diethylcarbonate, diphenylcarbonate, ethylenecarbonate, propylenecarbonate, boric acid esters (e.g., tributyl borate, tripentyl borate). Of these esters, it is particularly preferred to use, singly or in mixture, tricresyl phosphate from the standpoint of stabilization of the emulsified dispersion of the color developer.

Organic solvents having a lower boiling point can be added as a dissolution assistant to the foregoing organic solvents. Some of these additional organic solvents are preferably ethylacetate, isopropyl acetate, butyl acetate, methylene chloride, and the like.

Water soluble high polymers to be contained as a protective colloid in an aqueous phase, which is to be mixed with an oily phase wherein color developers are dissolved, can be selected suitably from known anionic, nonionic or amphoteric high polymers. Of these high polymers, polyvinylalcohol, gelatin, cellulose derivatives and the like are preferred.

Surface active agents to be contained additionally in the aqueous phase can be selected suitably from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium dodecylbenzenesulfonate), sodium alkyl sulfate (such as sodium lauryl sulfate), sodium dioctylsulfosuccinates, and polyaklylene glycols (such as polyoxyethylene nonylpheny ether).

An emulsified dispersion of color developer to be used in the present invention can be prepared with ease by mixing an oil phase containing the color developers and an aqueous phase containing a protective colloid and a surface active agent with a general means for preparing a fine grain emulsion, such as a high speed stirrer, an ultrasonic disperser, or the like to disperse the former phase in the latter phase.

To the emulsified dispersion thus obtained, melting point depressant for the color developer can be added, if desired. Some of these melting point depressants have such a function as to control glass transition points of the capsule walls described hereinbefore, too. Specific examples of such melting point depressants include hydroxy compounds, carbamate compounds, sulfonamide compounds, and aromatic methoxy compounds. Details of these compounds are described in Japanese Patent Application No. 59-244190, for example.

This melting point depressant can be used in an amount of 0.1 to 2 parts by weight, preferably 0.5 to 1 parts by weight, for 1 part by weight of color developer whose melting point is to be depressed. It is desirable that the melting point depressant and the color developer, whose melting point can be depressed thereby, be added at the same time. When they are added at different times, a preferred addition amount of the melting point depressant is 1 to 3 times that of the color developer.

For the purpose of prevention of sticking to a thermal head, and improvement in writing quality, pigments such as silica, barium sulfate, titanium oxide, aluminum hydroxide, zinc oxide, calcium carbonate, etc., styrene beads, or fine particles of urea/melamine resin can be added to the heat sensitive recording material of the present invention. For keeping the heat sensitive layer transparent, it is preferable to provide on the heat sensitive layer a protective layer for better keeping quality and stability according to a known process, and to add a pigment to the protective layer. Details of the protective layer can be seen, e.g., in "Kami Pulp Gijutsu Times" pp. 2 to 4, (September 1985).

Also, metal soaps can be added for the purpose of prevention of the sticking phenomenon. They are used at a coverage of 0.1 to 7 g/m$^2$.

The heat sensitive recording material of the present invention can be formed using a coating technique with the aid of an appropriate binder.

As for the binder, water soluble polymers and various kinds of emulsions, such as polyvinyl alcohol, a methyl cellulose, a carboxymethyl cellulose, a hydroxypropyl cellulose, a gum arabic, a gelatin, a polyvinyl pyrrolidone, a casein, styrene-butadiene atex, an acrylonitrilebutadiene latex, a polyvinyl acetate emulsion, a polyacrylate emulsion, and an ethylene-vinyl acetate copolymer emulsion can be employed. The amount of the binder used is 0.5 to 5 g/m$^2$ on a solid basis.

The heat sensitive recording material of the present invention is produced by providing a heat sensitive layer on a support, such as paper or a synthetic resin film, by coating and drying a coating composition, in which microcapsules enclosing a color former therein and a dispersion containing at least a color developer in an emulsified condition are contained as main components, and further a binder and other additives are incorporated, according to a conventional coating method, such as a bar coating method, a gravure coating method, a roll coating method, a spray coating method, or a dip coating method. A coverage of the heat sensitive layer is controlled so as to range from 2.5 to 25 g/m$^2$ on a solid basis. It was surprising to find that the prepared heat sensitive layer had very excellent transparency though the reasons are not known.

As for the paper to be used as a support, neutralized paper which is sized with a neutral sizing agent like an alkylketen dimer and shows pH 6-9 upon hot extraction (Japanese Laid-Open Patent Publication No. 55-14281) is employed to advantage in the respect of long-range preservation.

In order to prevent the penetration of a coating composition into paper and in order to effect a close contact between a thermal recording head and a heat sensitive recording layer, paper described in Japanese Laid-Open Patent Publication No. 57-116687, which is characterized by Stökigt sizing degree/(meter basis weight)$^2 \geqq 3 \times 10^{-3}$ and Beck smoothness of 90 seconds or more, is used to advantage.

In addition, paper having optical surface roughness of 8 μ or less and a thickness of 40 to 75 μ, as described in Japanese Laid-Open Patent Publication No. 58-136492; paper having a density of 0.9 g/cm$^3$ or less and optical contact tact rate of 15% or more, as described in Japanese Laid-Open Patent Publication No. 58-69097; paper which is prepared from pulp having received a beating treatment till its freeness has come to 400 cc or more on a basis of Canadian Standard Freeness (JIS P8121) to prevent permeation of a coating composition thereinto, as described in Japanese Laid-Open Patent Publication No. 58-69097; raw paper made with a Yankee paper machine, which is to be coated with a coating composition on the glossy side and thereby, improvements on developed color density and resolution are intended, as described in Japanese Laid-Open Patent Publication No. 58-65695; raw paper which has received a corona discharge processing and thereby, its coating aptitude has been enhanced, as described in Japanese Laid-Open Patent Publication No. 59-35985; and so on can be employed in the present invention, and can bring about good results. In addition to the above-described papers, all supports which have so far been used for general heat sensitive recording papers can be employed as the support of the present invention.

Since the heat sensitivity of the heat sensitive material of the present invention is high though the heat sensitive layer thereof is transparent, images can be formed on the heat sensitive material by a thermal head used in a facsimile receiver or the like. If a transparent film is used as the support of the heat sensitive material, then the heat sensitive material can be used on an OHP immediately after signals have been received and recorded on the heat sensitive material by a facsimile receiver. Even when a multicolor heat sensitive material is employed, because a colored image is not affected by the nontransparency of the heat sensitive layer, the image has good edge sharpness, and its color reproducibility is good.

Examples of the heat sensitive material of the present invention will be described below in further detail. However, the heat sensitive material is not limited to the examples given below.

EXAMPLE 1

Preparation of Capsule Solution 14 g of Crystal Violet lactone (leuco dye), 60 g of Takenate D 110N (Trade name of capsule wall material, produced by Takeda Yakuhin K.K.), and 2 g of Sumisoap 200 (Trade name of ultraviolet absorbent, produced by Sumitomo Kagaku, K.K.) were added to a mixed solvent consisting of 55 g of 1-phenyl-1-xylylethane and 55 g of methylene chloride, and dissolved therein. The solution of the above-described leuco dye was mixed with an aqueous solution constituted with 100 g of an 8water solution of polyvinyl alcohol, 40 g of water, and 1.4 g of a 2% water solution of sodium diocrylsulfosuccinate (dispersant), and emulsified by stirring at 10,000 r.p.m. for 5 minutes using Ace Homogenizer made by Nippon Seiki K.K.. Then, the resulting emulsion was diluted with 150 g of water, and allowed to stand at 40° C. for 3 hours to conduct the microencapsulation reaction therein. Thus, a solution containing microcapsules having a size of 0.7 μ was obtained.

Preparation of Color Developer-emulsified Dispersion

The color developers (a), (b), and (c) represented by the structural formulae illustrated below were added in amounts of 8 g, 4 g, and 30 g, respectively, to a solvent mixture of 2.0 g of 1-phenyl-1-xylylethane. 6.0 g of dibutylphthalate, and 30 g of ethyl acetate, and dissolved therein. The thus obtained solution of the color developers was mixed with 100 g of an 8% water solution of polyvinyl alcohol, 150 g of water, and 0.5 g of sodium dodecylbenzensulfonate, and emulsified by stirring at 10,000 r.p.m. for 5 minutes at room temperature using Ace Homogenizer made by Nippon Seiki K.K. to prepare an emulsified dispersion having a grain size of 0.5 μ.

Color Developer (a)
Zinc Salt of

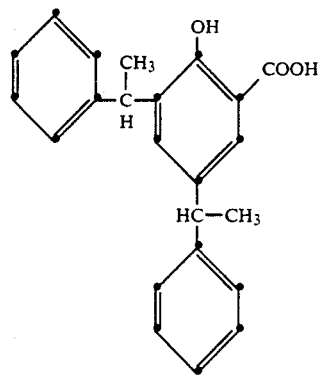

Color Developer (b)

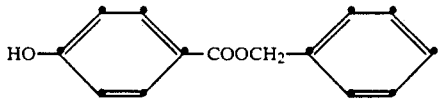

Color Developer (c)

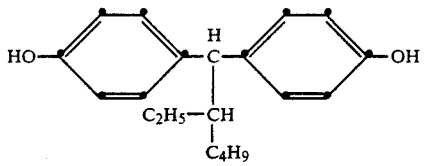

A 5.0 g portion of the foregoing capsule solution, a 10.0 g portion of the foregoing color developer-emulsified dispersion, and 5.0 g of water were mixed by stirring, coated on a 70 μ-thick transparent polyethylene terephthalate (PET) film support at a coverage of 15 g/m$^2$ on a solid basis, and dried. Then, a 2 μ-thick protective layer having the following composition was further provided thereon to produce a transparent heat sensitive film.

| (Composition of Protective Layer) | |
|---|---|
| 10% water solution of polyvinyl alcohol | 20 g |
| Water | 30 g |
| Sodium salt of 2% dioctyl sulfosuccinate | 0.3 g |
| Kaolin dispersion of 3 g of polyvinylalcohol, 100 g of water, and 35 g of Kaolin dispersed by ball mill | 3 g |

-continued

| (Composition of Protective Layer) | |
|---|---|
| Hidolin Z-7 (manufactured by Chukyo Yashi K.K.) | 0.5 g |

On the thus obtained heat sensitive recording material, thermal recording was carried out using a G III-mode thermal printer (Mitsubishi Melfas 600 (trade name) manufactured by Mitsubishi Denki K.K.) and a blue image was obtained. A transmittal image density was measured as 0.7 using McBeth densitometer and the image could be seen by an OHP.

EXAMPLES 2-12 and COMPARATIVE EXAMPLE 1

A transparent blue image was obtained by the same procedure as in Example 1 except using the following oils cited in Table 1 instead of the 1-phenyl-1-xylylethane and the dibutyl phthalate used for the preparation of a color developer-emulsified dispersion.

TABLE 1

| Example | Oil | Density | Stability |
|---|---|---|---|
| 2 | tricresylphosphate | 0.53 | Excellent |
| 3 | tricresylphosphate/ diethylmaleate | 0.61 | Excellent |
| 4 | di-isodecylphthalate | 0.60 | Good |
| 5 | di-butylphthalate | 0.61 | Good |
| 6 | dioctyladipate | 0.62 | Good |
| 7 | dioctylazelate | 0.59 | Good |
| 8 | dibutylfumalate | 0.57 | Good |
| 9 | diphenylcarbonate | 0.57 | Good |
| 10 | propylenecarbonate | 0.57 | Good |
| 11 | diethylmaleate | 0.59 | Good |
| 12 | dibutylmaleate | 0.59 | Good |
| Comparative Example 1 | 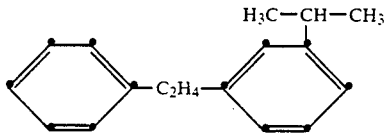 | 0.59 | Bad |

Each of the thus obtained color developer-emulsified dispersions was diluted by adding 0.5 parts of water, stirred for 6 hours by a stirrer, and then coated on a PET base. The surface condition of each coat was visually observed, and comparison between the color developer emulsions was made for emulsification stability. The results are shown in Table 1 above together with the McBeth transmission density.

It has been confirmed that a heat sensitive material thus prepared which has a heat sensitivity of 100 $mJ/mm^2$ or below can develop a color. The heat sensitivity of the heat sensitive material of the present invention is lower than that of the conventional heat sensitive materials. Therefore, an image recording apparatus which uses the heat sensitive material according to the present invention consumes a lower amount of electric power.

The heat sensitive material specified above is employed as the transparent heat sensitive film F in the image recording apparatus of the present invention.

Operation and advantages of the image recording apparatus and the thermal head drive system for recording an image on the above heat sensitive recording material will be describe below.

The image recording apparatus is connected through the video signal input terminal 12 to a medical image diagnostic apparatus such as an X-ray computerized tomographic apparatus, an ultrasonic imaging apparatus, or the like. After an image has been displayed on a monitor of the medical image diagnostic apparatus and observed by a doctor or the like, the image is recorded on the transparent heat sensitive film F, which is produced as a hard copy.

Figure 4:
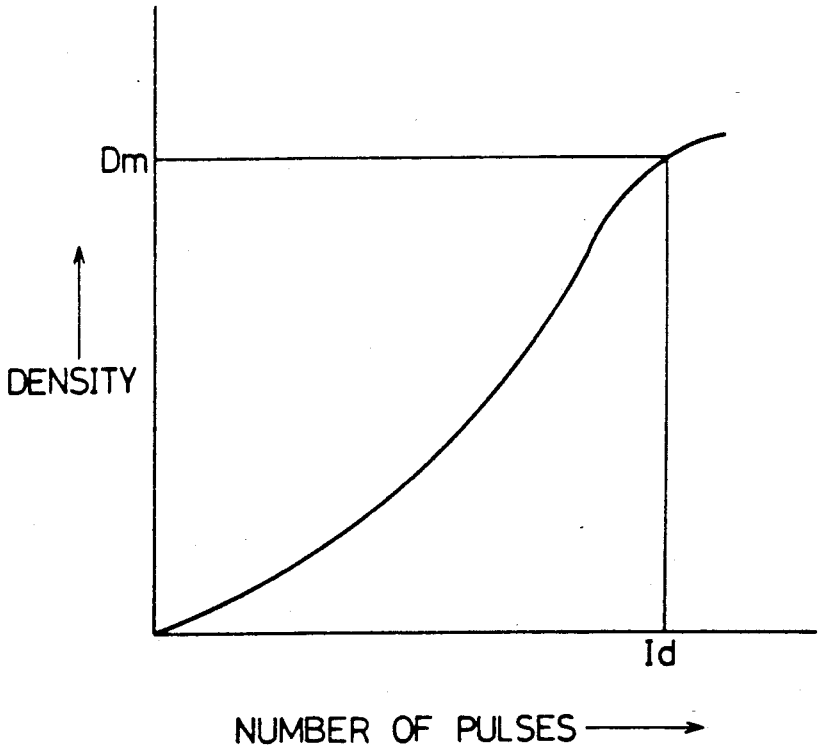
FIG. 4 is a graph showing the density characteristics of the transparent heat-sensitive film.

When the image on the monitor is confirmed by the doctor or the like, the doctor or the like operates the control panel 36 of the initial value setting unit 22 to set an initial value Id for the background density of the image displayed on the monitor. The transparent heat sensitive film F normally has density characteristics as shown in FIG. 4, such that the recorded density on the film F varies depending on the number of pulses applied to the heating elements Tp0 through Tpn−1 of the thermal head 18. As described above, the memory addresses in the line buffer memory 30 correspond respectively to the n heating elements Tp0 through Tpn−1. Therefore, the doctor or the like enters an initial value Id (actually, pulse number data) corresponding to a certain density Dm (see FIG. 4) to be recorded into all memory addresses M0 through Mn-1 (see FIG. 5(*a*)) of the line buffer memory 30 by operating the keyboard of the control panel 36.

After such a preparatory action, a composite video signal $S_0$ carrying the image information of a localized region of a patient's body is supplied from the medical image diagnostic apparatus to the video I/F 24 through the video signal input terminal 12. The video I/F 24 supplies the signal input terminal of the A/D converter 26 with a video signal $S_1$ with its video signal amplitude and pedestal level adjusted to the full scale voltage of the A/D converter 26. At the same time, the video I/F 24 separates a composite sync signal $S_2$ from the composite video signal $S_0$, and applies the composite sync signal $S_2$ to the sync generator 28. The sync generator 28 comprises a PLL frequency multiplier synthesizer or the like. The frequency of a horizontal synchronizing signal of the composite sync signal $S_2$ is multiplied by the sync generator 28. The frequency-multiplied signal is then applied as a clock signal $S_3$ from the sync generator 28 to the clock input terminals $CK_1$, $CK_2$ of the the A/D converter 26 and the frame memory 29.

Each time the clock signal $S_3$ is applied, the video signal $S_1$ is converted to digital image data $S_5$ by the A/D converter 26, and the digital image data $S_5$ are introduced into the frame memory 29. The digital image data $S_5$ are successively stored in the respective addresses in the frame memory 29 until one frame of image data is stored in the frame memory 29. The one-frame image data stored in the frame memory 29 are then fed to the line buffer member 30 as one-line data $S_6$ at a time which correspond to one scanning line.

Figure 6:
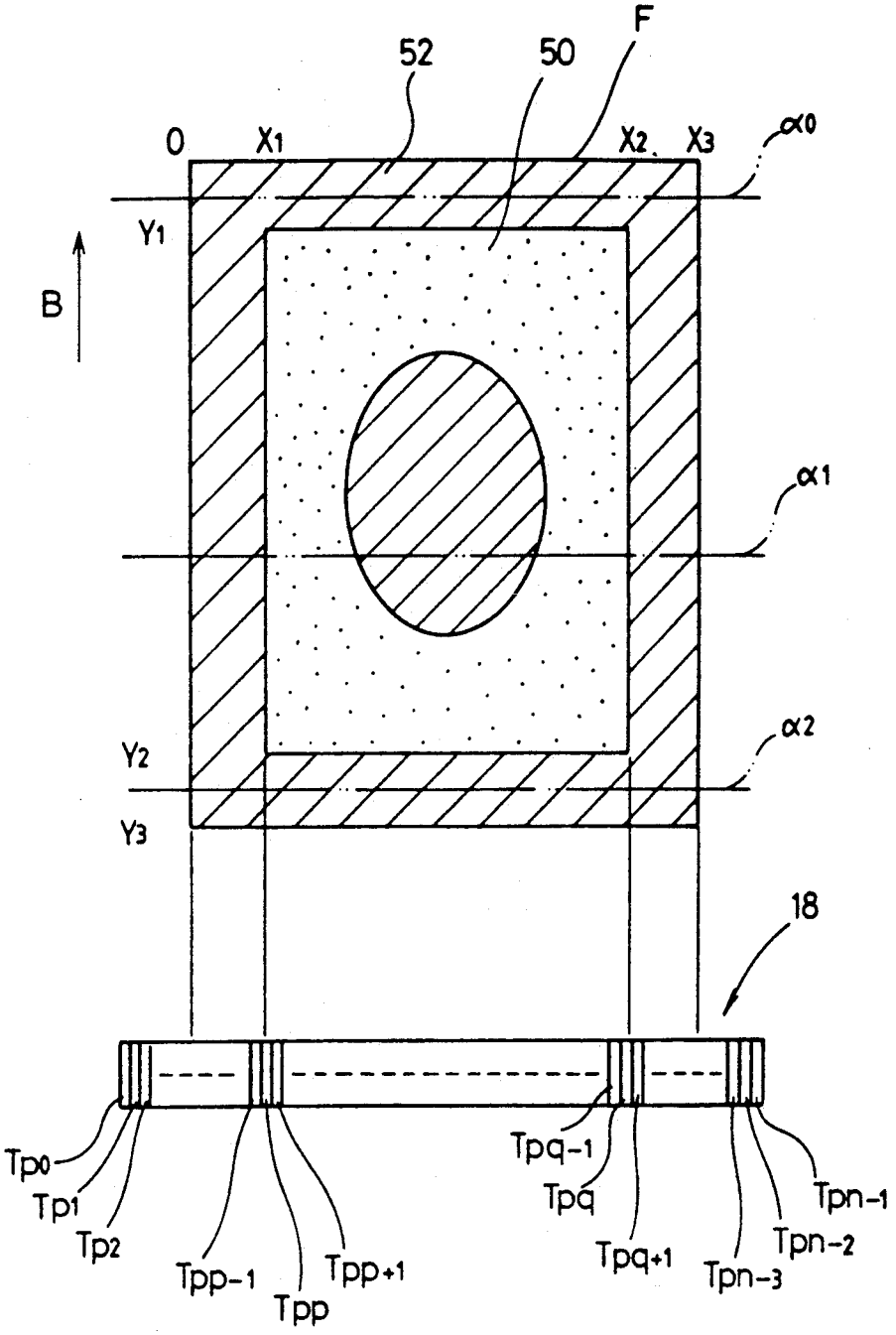
FIG. 6 is a view showing the manner in which an image is thermally recorded on the transparent heat sensitive film by a thermal head.

The line data $S_6$ fed to the line buffer memory 30 are then converted by the line buffer memory 30 to line data $S_7$ (described in detail later) which are then supplied through the P/S converter 32 to the thermal head driver 34. The thermal head driver 34 then supplies the heating elements Tp0 through Tpn-1 of the thermal head 18 with drive current pulses depending on the line data $S_7$, i.e., the pulse number data stored in the memory addresses M0 through Mn−1 in the line buffer memory 30. The heating elements Tp0 through Tpn−1 are then heated by the supplied drive current pulses for thermally recording a one-line image on the transparent heat sensitive film F. The transparent heat sensitive film F, while being pressed against the thermal head 18 by a platen roller (not shown), is fed in the auxiliary scanning direction indicated by the arrow B as shown in FIG. 6. Successive thermal recording of one-line image data on the transparent heat sensitive film F in the main scanning direction indicated by the arrow A with the thermal head 18, therefore, reproduces a two-dimensional image on the transparent heat sensitive film F.

Figure 5:
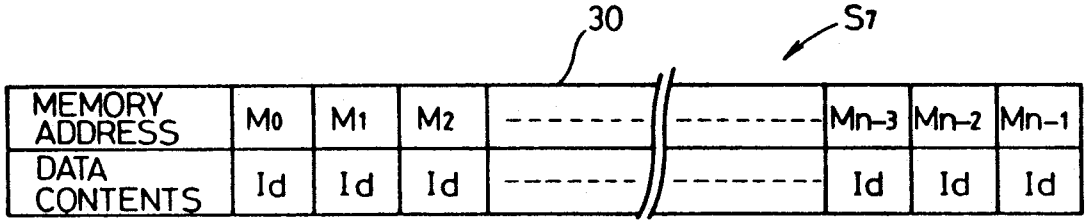
FIGS. 5(a) and 5(b) are diagrams illustrating memory addresses and data contents of a line buffer memory shown in FIG. 2.
Figure 5:
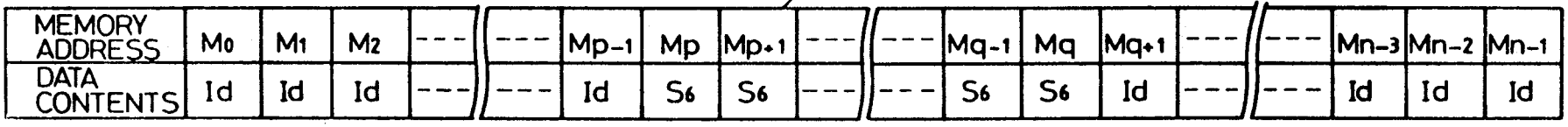

At this time, the areas of the film F between the positions 0 and $Y_1$ and the positions $Y_2$ and $Y_3$ are thermally recorded with line data $S_7$ from the line buffer 30 as shown in FIG. 5(*a*). Therefore, these film areas are recorded at the density Dm corresponding to the initial value Id fully along scanning lines $\alpha_0$, $\alpha_2$. The areas of the film F between the positions $Y_1$ and $Y_2$ is thermally recorded with line data $S_7$ as shown in FIG. 5(*b*). More specifically, the film area corresponding to the memory addresses M0 through Mp−1 (i.e., the heating elements Tp0 through Tpp−1), and the film area corresponding to the memory addresses Mq+1 through Mn−1 (i.e., the heating elements Tpq+1 through Tpn−1) along a scanning line $\alpha_1$ are thermally recorded at the density Dm corresponding to the initial value Id. The film area corresponding to the memory addresses Mp through Mq (i.e., the heating elements Tpp through Tpq) along the scanning line $\alpha_1$ is thermally recorded at the signal level of the line data $S_6$.

Therefore, an image is recorded on the image area 50 of the film F based on the line data $S_6$, i.e., the composite video signal $S_0$ supplied to the image recording apparatus, whereas a background image is recorded in the non-image area 52 at the density Dm corresponding to the initial value Id. The transparent heat sensitive film F thus recorded is then placed on a light table such as an illuminating box and visually observed by the doctor or the like. Sinoe no glaring light passes through the non-image area 52, the doctor or the like is allowed to observe the image area 52 for a period of time long enough to diagnose the imaged region accurately.

Inasmuch as the effective print width $W_T$ of the thermal head 18 is slightly larger than the film width $W_F$ as shown in FIG. 3, the background image of the density Dm can be recorded, without fail, on the entire surface of the nonimage area 52.

Figure 7:
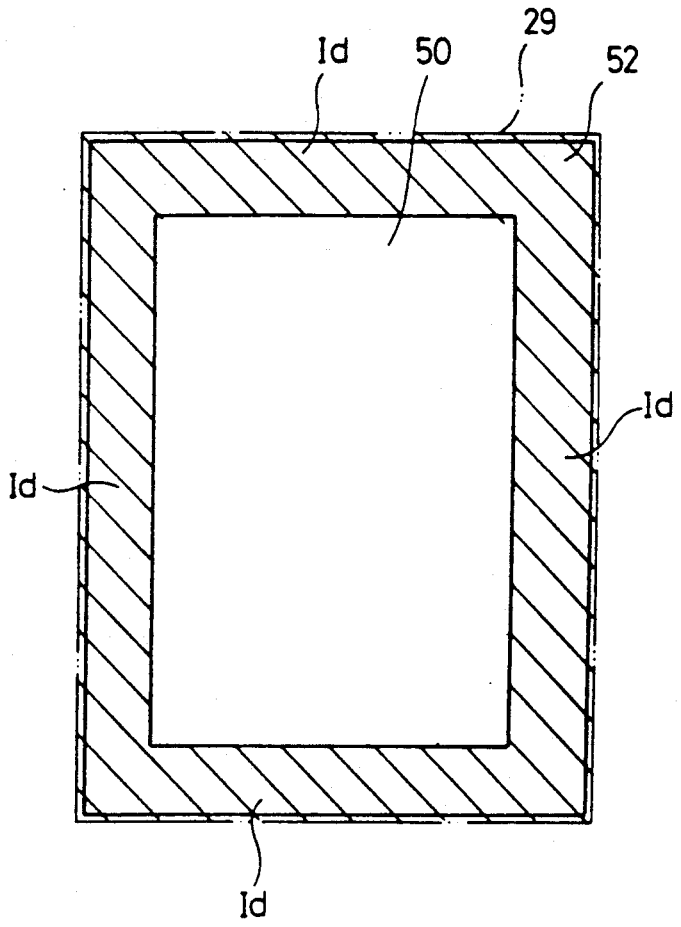
FIG. 7 is a schematic diagram illustrating an image recording apparatus according to another embodiment of the present invention.

In the above embodiment, the initial density value Id is set in the line buffer memory 30. However, the output signal indicative of the initial value Id from the initial value setting circuit 38 shown in FIG. 2 may be supplied to the frame memory 29, and, as shown in FIG. 7, the initial value Id may be stored in memory addresses (shown hatched in FIG. 7) in the frame memory 29 which correspond to the nonimage area 52. Alternatively, the initial value Id may first be stored in all memory addresses in the frame memory 29, and then an image image signal may be stored over the stored initial value data in selected memory addresses in the frame memory 29.

The transparent heat sensitive recording material which can be employed in the present invention may be not only the heat sensitive sensitive material disclosed in Japanese Patent Application No. 62-88197 as described above, but also the heat sensitive recording material disclosed in Japanese Laid-Open Patent Publication No. 63-318546 filed by the applicant. The heat sensitive recording material disclosed in the latter publication comprises a photosensitive heat sensitive recording material including a support and a photosensitive heat sensitive layer disposed on one surface of the support and having a diazo compound and a coupler. Either the diazo compound or the coupler is contained in microcapsules, whereas the other is dissolved into an organic solvent that is slightly soluble or insoluble in water, and emulsified and dispersed to produce an emulsified dispersion. The microcapsules and the emulsified dispersion are mixed with each other into a coating solution, which is coated on the supported and dried. The photosensitive heat sensitive layer thus coated and dried is substantially transparent. After an image has been thermally recorded on the photosensitive heat sensitive recording material, its entire surface is exposed to ultraviolet radiation which photosets non-heated areas.

It has been confirmed that a photosensitive heat sensitive material thus prepared which has a heat sensitivity of 100 $mJ/mm^2$ or below can develop a color. Therefore, an image recording apparatus which uses the photosensitive heat sensitive material according to the present invention consumes a lower amount of electric power.

With the present invention, as described above, when an image, characters, or the like is recorded on a heat sensitive material with a thermal head, a non-image area of the heat sensitive material other than an image area thereof on which the image or the like is recorded in response to an input image signal is recorded at a predetermined density. Therefore, when the image on the heat sensitive material, which is a transparent heat sensitive material here, is visually observed on a light table such as an illuminating box or the like, unwanted glaring light is prevented from passing through the non-image area toward the viewer of the image so that the viewer can easily observe the image without physical strains on the eyes. According to the present invention, in addition, a high-quality image can be produced by a light beam scanning mechanism on the highly sensitive transparent heat sensitive material disclosed in Japanese Patent Application No. 62-88197 as described above Although certain preferred embodiments have been shown and described, it should be understood that many changes and modifications may be made therein without departing from the scope of the appended claims.

What is claimed is:

1. A method of recording an image on a transparent heat sensitive material having a transparent support and a transparent heat sensitive layer disposed on the transparent support, said method comprising the steps of:

initializing memory means to an initial value corresponding to a predetermined density level;

moving the transparent heat sensitive material in an auxiliary scanning direction;

recording image information on the transparent heat sensitive material in a main scanning direction substantially normal to said auxiliary scanning direction with a thermal head having an array of as many heating elements as a number of pixels along said main scanning direction, so that the transparent heat sensitive material is two-dimensionally scanned to record an image in an image area thereon; and recording a non-image area of the transparent heat sensitive material other than said image area thereof at said predetermined density level based on said initial values.

2. A method according to claim 1, wherein said array of heating elements has a length larger than a width of the transparent heat sensitive material in said main scanning direction, so that an entire surface of said nonimage area can be recorded at said predetermined density level.

3. A method of recording an image on a transparent heat sensitive material, according to claim 1, wherein said step of recording a non-image area is performed in response to a predetermined number of pulses corresponding to said predetermined density level.

4. A method according to claim 1, wherein said memory means corresponds to a line buffer memory, and said initializing step stores said initial value in every address of said line buffer memory.

5. A method according to claim 1, wherein said memory means constitutes a frame memory and said initializing step stores said initial value in every address of said frame memory.

6. A method according to claim 1, wherein said memory means constitutes a frame memory and said initializing step stores said initial value only in addresses of said frame memory corresponding to said non-image area of said transparent heat sensitive material.

7. An apparatus for recording an image on a transparent heat sensitive material having a transparent support and a transparent heat sensitive layer disposed on the transparent support, said apparatus comprising:

means for moving the transparent heat sensitive material in an auxiliary scanning direction;

a thermal head having an array of as many heating elements as a number of pixels along a main scanning direction substantially normal to said auxiliary scanning direction;

a frame memory for storing a frame of input image data;

a line buffer memory for storing a line of input image data corresponding to a scanning line and supplied from said frame memory, said line buffer memory having at least memory areas corresponding respectively to said heating elements;

initial data input means for supplying initial density level data corresponding to one scanning line to said line buffer memory, wherein one of said frame memory and said line buffer memory initially store said initial density level data;

thermal head drive means for energizing said heating elements to record image information on the transparent heat sensitive material in said main scanning direction while the transparent heat sensitive material is being moved in said auxiliary scanning direction, so that the transparent heat sensitive material is two-dimensionally scanned to record an image in an image area thereof; and means for recording a non-image area of the heat sensitive material other than said image area thereof at a predetermined density level represented by said initial density level data.

8. The apparatus of claim 7, wherein said array of heating elements has a length longer than a width of the transparent heat sensitive material in said main scanning direction, so that an entire surface of said non-image area can be recorded at said predetermined density level.

9. An apparatus for recording an image on a transparent heat sensitive material, according to claim 7, wherein said means for recording a non-image area operates in response to a predetermined number of pulses corresponding to said predetermined density level.

10. An apparatus according to claim 7, wherein every address of said line buffer memory is set initially to equal said initial density level data.

11. An apparatus according to claim 7, wherein every address of said frame memory is set initially to equal said initial density level data.

12. An apparatus according to claim 7, wherein only memory addresses of said frame memory, corresponding to said non-image area, is set initially to equal said initial density level data.

13. An apparatus for recording an image on a transparent heat sensitive material having a transparent support and a transparent heat sensitive layer disposed on the transparent support, said apparatus comprising:

means for moving the transparent heat sensitive material in an auxiliary scanning direction;

a thermal head having an array of as many heating elements as a number of pixels along a main scanning direction substantially normal to said auxiliary scanning direction;

a frame memory for storing a frame of input image data;

a line buffer memory for storing a line of input image data corresponding to a scanning line and supplied from said frame memory, said line buffer memory having at least memory areas corresponding respectively to said heating elements;

initial data input means for supplying initial density level data corresponding to one scanning line, said initial level density data being initially stored in one of said frame memory and said line buffer memory;

thermal head drive means for energizing said heating elements to record image information on the transparent heat sensitive material in said main scanning direction while the transparent heat sensitive material is being moved in said auxiliary scanning direction, so that the transparent heat sensitive material is two-dimensionally scanned to record an image in an image area thereof; and means for recording a non-image area of the heat sensitive material other than said image area thereof at a predetermined density level represented by said initial density level data.

14. The apparatus of claim 13, wherein said array of heating elements has a length longer than width of the transparent heat sensitive material in said main scanning direction, so that entire surface of said non-image area can be recorded at said predetermined density level.

15. An apparatus for recording an image on a transparent heat sensitive material, according to claim 13, wherein said means for recording a non-image area operates in response to a predetermined number of pulses corresponding to said predetermined density level.

16. An apparatus according to claim 13, wherein every address of said line buffer memory is set initially to equal said initial density level data.

17. An apparatus according to claim 13, wherein every address of said frame memory is set initially to equal said initial density level data.

18. An apparatus according to claim 13, wherein only memory addresses of said frame memory, corresponding to said non-image area, is set initially to equal said initial density level data.

19. An apparatus for recording an image on a transparent heat sensitive material having a transparent support and a transparent heat sensitive layer disposed on the transparent support, said apparatus comprising:

means for moving the transparent heat sensitive material in an auxiliary scanning direction;

a thermal head having an array of as many heating elements as a number of pixels along a main scanning direction substantially normal to said auxiliary scanning direction;

a frame memory for storing initial density level data in all memory addresses thereof and for subsequently storing a frame of input image data in a predetermined portion of said frame memory over the stored initial image data;

a line buffer memory for storing a line of input image data corresponding to a scanning line and supplied from said frame memory, said line buffer memory having at least memory areas corresponding respectively to said heating elements;

thermal head drive means for energizing said heating elements to record image information on the transparent heat sensitive material in said main scanning direction while the transparent heat sensitive material is being moved in said auxiliary scanning direction, so that the transparent heat sensitive material is two-dimensionally scanned to record an image in an image area thereof; and means for recording a non-image area of the heat-sensitive material other than predetermined density level represented by said initial density level data.

20. The apparatus of claim 19, wherein said array of heating elements has a length longer than a width of the transparent heat sensitive material in said main scanning direction, so that an entire surface of said non-image area can be recorded at said predetermined density level.

21. An apparatus for recording an image on a transparent heat sensitive material, according to claim 19, wherein said means for recording a non-image area operates in response to a predetermined number of pulses corresponding to said predetermined density level.

* * * * *